US005816363A

United States Patent [19]

Searcy

[11] Patent Number: 5,816,363

[45] Date of Patent: Oct. 6, 1998

[54] LADDER BRACKET

[76] Inventor: Marilyn A. Searcy, 47000 Warm Springs Blvd., #378, Fremont, Calif. 94539

[21] Appl. No.: 806,334

[22] Filed: Feb. 26, 1997

[51] Int. Cl.[6] ..... E06C 7/14

[52] U.S. Cl. ..... 182/129; 248/210; 248/315

[58] Field of Search ..... 182/129; 248/210, 248/211, 238, 315

[56] References Cited

U.S. PATENT DOCUMENTS

| | | | |
|---|---|---|---|
| D. 266,964 | 11/1982 | Rasheed . | |
| D. 313,169 | 12/1990 | Scott et al. . | |
| D. 324,054 | 2/1992 | Smith . | |
| 1,077,027 | 10/1913 | Austin | 248/315 |
| 1,539,850 | 6/1925 | Kostenbauder | 248/315 X |
| 1,858,656 | 5/1932 | Batherman | 248/210 |
| 1,930,673 | 10/1933 | Consolazio | 248/315 |
| 2,235,986 | 3/1941 | Ellingson | 248/315 X |
| 2,242,833 | 5/1941 | Nibur | 248/315 |
| 2,732,954 | 1/1956 | Janonis et al. | 248/315 X |
| 2,774,562 | 12/1956 | Henry | 248/315 X |
| 2,880,953 | 4/1959 | Dicks | 248/210 |
| 2,895,700 | 7/1959 | Johnson | 248/210 |
| 2,911,133 | 11/1959 | Ruggieri . | |
| 2,963,252 | 12/1960 | Caporicci | 248/210 X |
| 3,285,557 | 11/1966 | Reda | 248/210 |
| 3,300,167 | 1/1967 | Malicoat . | |
| 3,332,653 | 7/1967 | Hoelzel . | |
| 3,420,486 | 1/1969 | Baker . | |
| 3,809,351 | 5/1974 | Bravo et al. . | |
| 5,293,957 | 3/1994 | Lunden, Jr. . | |

FOREIGN PATENT DOCUMENTS

| | | | |
|---|---|---|---|
| 49353 | 9/1934 | Denmark | 248/210 |
| 14729 | of 1907 | United Kingdom | 248/210 |
| 197158 | 5/1923 | United Kingdom | 248/210 |
| 855081 | 11/1960 | United Kingdom | 248/210 |
| 2110750 | 6/1983 | United Kingdom | 182/129 |
| 2180874 | 4/1987 | United Kingdom | 182/129 |

*Primary Examiner*—Ramon O. Ramirez
*Assistant Examiner*—Long Dinh Phan
*Attorney, Agent, or Firm*—Harris Zimmerman

[57] ABSTRACT

A device for supporting a paint container on a ladder includes a tang having a lower surface adapted to impinge on a step of a ladder. Extending from one end of the tang is a gripper portion that is formed to impinge on the bottom surface of the step on which the tang impinges, whereby the device is clamped to the step. An arcuate portion extends from the other end of the tang, and is provided with an opening having a diameter dimensioned to receive a paint container, such as a standard bucket. In one embodiment, the arcuate portion consists of a loop of heavy wire formed in a curve to define the opening that supports the paint container. A pair of parallel, linear member extends from the circle are joined to the tang member. The linear members extend past the tang, and include first and second pairs of right angle bends that redirect the linear members retrograde toward the loop portion. The retrograde portions of the linear members are spaced apart from the gripper portions a sufficient distance to engage the thickness of a ladder step therebetween. A painter's tray that may be removably secured to the loop portion of the device. The tray includes a plurality of channel portions secured to the bottom surface thereof and disposed to slidably engage portions of the loop and the tang to secure the tray to the device. The tray may include a plurality of compartments for different purposes.

11 Claims, 3 Drawing Sheets

LADDER BRACKET

BACKGROUND OF THE INVENTION

The present invention relates to paint container holders for use in conjunction with ladders, and, more particularly, to a paint container holder supported by a ladder for use by a person perched on the ladder.

It is well known to use ladders, scaffolding, and the like for support when preparing and painting surfaces that are unreachable when standing on floor or ground surfaces. In utilizing a ladder a painter is confronted with the problem of supporting a paint container in a position where it is convenient to add paint to the brush, roller, or other painting tool. It is notably inconvenient, and even dangerous, for the painter to use one hand to hold the paint container while wielding a brush with the other hand. In response to this problem, some ladders such as stepladders are provided with a fold-out shelf adjacent to the top thereof to support a paint can or tray. These fold-out shelves are notoriously unstable and unreliable, providing ample opportunity for the container to fall therefrom during normal use of the ladder.

There are other devices known in the prior art for supporting paint containers on ladders. These devices generally comprise brackets of various forms that are removably secured to rungs of a ladder, or the ladder rail, or some combination of the two. These devices often include elaborate shapes or features adapted to secure a bracket to the typically rounded ladder rungs. Even so, it is possible for the painter to dislodge some of these devices by climbing on and thereby shaking the ladder, or by accidentally stepping on a portion of the bracket while climbing the ladder.

There are also devices known in the prior art for stabilizing a paint container supported on the shelf of a stepladder. These devices typically rely on the existing fold-out shelf as a main supporting element, and thereby incorporate the structural weaknesses of the existing shelf and its potential for failure. There in an unmet need in the prior art for a device that supports a paint container on a ladder, particularly a stepladder, and that is stable and reliable.

SUMMARY OF THE PRESENT INVENTION

The present invention generally comprises a device for supporting a paint container on a ladder for use by a painter on the ladder. The device includes a tang having a lower surface adapted to impinge on a step of a ladder, such as the top step of a step ladder. Extending from one end of the tang is a gripper portion that is formed to extend and impinge on the bottom surface of the step on which the tang impinges, whereby the device is clamped and secured to the step. An arcuate portion extends from the other end of the tang, and is provided with an opening having a diameter dimensioned to receive a paint container, such as a standard 2 gallon or 5 gallon bucket, or the like. The paint container is supported in cantilever fashion from the arcuate portion by the gripper portion secured to the ladder step.

In one embodiment of the invention, the arcuate portion consists of a loop of heavy wire or rod material formed in a curve to define the opening that supports the paint container. The loop of wire or rod describes a substantial portion of a circle, and extends from the circle as a pair of parallel, linear members. A tang member comprises a plate-like member extending between the linear member and including curved edge portions at opposed sides that substantially circumscribe and secure the linear members. The linear members include gripper portions that extend past the curved edge portions, and are provided with first and second pairs of generally right angle bends that redirect the linear members retrograde toward the loop portion. The retrograde portions of the linear members are also bent to converge slightly toward each other, and a third pair of bends is provided so that the free ends of the linear members diverge angularly downwardly from the plane of the gripper portions of the linear members. The first and second pairs of bends are arranged so that the retrograde portions of the linear members are spaced apart from the gripper portions a sufficient distance to engage the thickness of a ladder step therebetween.

The bucket or canister supported by the loop portion of the device may also be used to support tools for painting, plastering, surface preparation, drywall lay-up, plumbers, pipe fitters, and the like. Supporting tools and implements on the ladder itself reduces the need for a waist belt tool pouch, thereby eliminating a source of lower back strain. Moreover, having the tools at the top of the ladder reduces the number of trips up and down the ladder for tools and supplies. Each 5 gallon bucket may hold up to 20 pounds of tools, equipment, and supplies, and a 2 gallon bucket may support up to 8 pounds of such material.

The invention further provides a painter's tray that may be removably secured to the loop portion of the device. The tray includes a plurality of channel portions secured to the bottom surface thereof and disposed to slidably engage portions of the loop and the tang to secure the tray to the device. The tray may include a plurality of compartments for different purposes. For example, the compartments may be configured to hold various tools and implements for surface preparation, such as scrapers, tape, brushes, and other paraphernalia. The tray may further include a magnetic strip or portion to retain nails and screws removed from the surfaces being prepared.

Alternatively, the painter's tray may be configured for faux painting, with each compartment containing different color paints. One compartment may include a dabbing screen for removing excess paint from the faux applicators.

DESCRIPTION OF THE PREFERRED EMBODIMENT

Figure 1:
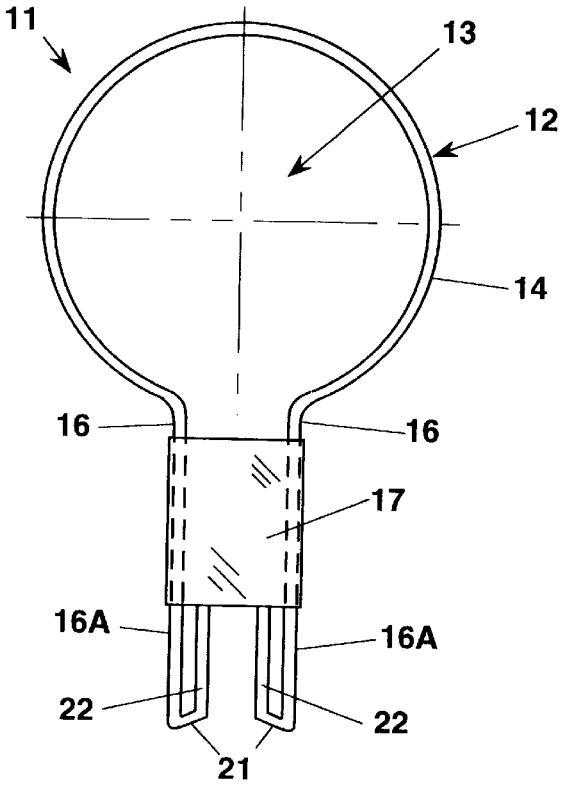
FIG. 1 is a plan view of the paint container support device of the present invention.

The present invention generally comprises a device for supporting a paint container on a ladder for use by a painter on the ladder. With regard to FIGS. 1–3, the device 11 includes an arcuate portion 12 comprised of stiff wire or rod material 14 formed in a smooth curved shape defines a central opening 13. The opening 13 is dimensioned to receive a paint container or bucket having a (typical) standard size such as 2 gallons, 5 gallons, or the like. The wire or rod 14 describes substantial portion of a closed curved loop, whereby a cylindrical container may be encircled and supported within.

Figure 2:
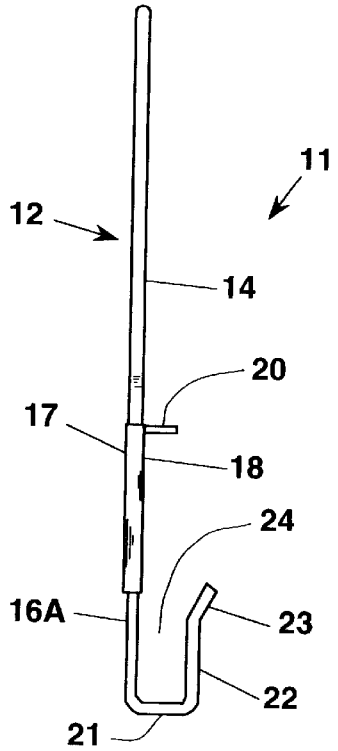
FIG. 2 is a side view of the paint container support device depicted in FIG. 1.
Figure 3:
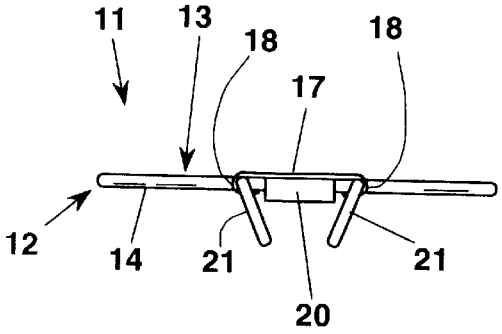
FIG. 3 is an end view of the paint container support device depicted in FIGS. 1 and 2.

The wire or rod member 14 extends integrally from the arcuate portion 12 as a pair of linear portions 16 disposed in parallel, spaced apart fashion. A tang member 17 comprised of a plate-like component includes opposed sides having curved edge portions 18 that substantially circumscribe and secure the linear portions 16, forming a rigid assembly therewith. A flange 20 is formed at one end of the tang 17 and extends between the linear segments 16, as shown in FIGS. 2 and 3. The paired linear segments extend proximally past the tang 17 as segments 16A, and undergo right angle bends to form short transition segments 21 that converge slightly each toward the other. Further right angle bends define retrograde segment 22 that extend generally parallel to their respective progenitor portions 16A. Each segment 22 terminates with a short segment 23 bent obliquely away from the tang 17. The segments 22 and 16A define therebetween an opening 24 dimensioned to receive a step of a ladder, as will be explained in the following description.

Figure 6:
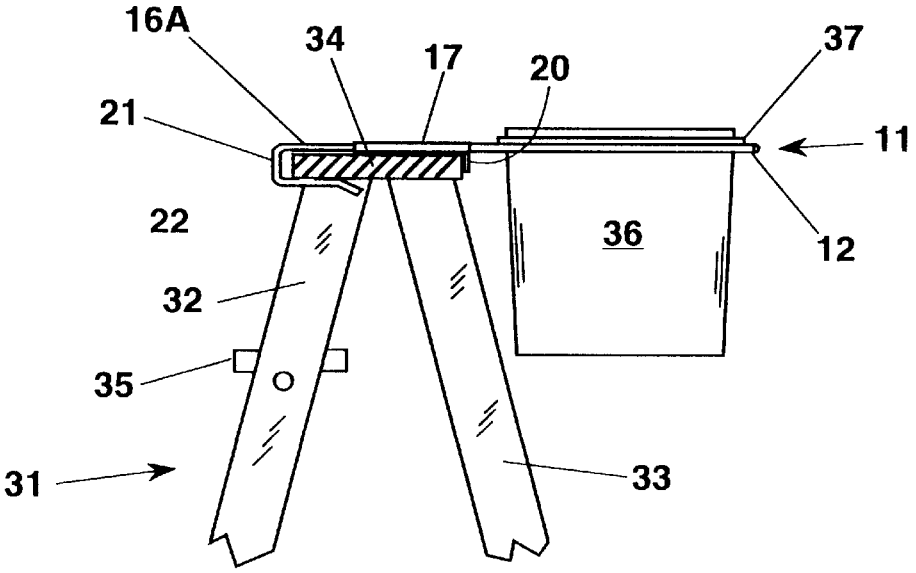
FIG. 6 is a side elevation depicting the paint container support device secured to the top step assembly of a conventional stepladder.

With regard to FIG. 6, the device 11 of the invention may be employed with a typical stepladder 31 known in the prior art. A stepladder generally includes a pair of parallel rails 32 bearing a plurality of steps 35, and another pair of parallel rails 33, both pairs of rails being pivotally joined to an upper step 34 (by hardware not shown for clarity). The device 11 is employed by engaging one lateral edge of step 34 (or 35) in the opening 24, and sliding the device 11 onto the step until the flange 20 extends over the opposed lateral edge of the step. The obliquely extending end segments 23 aid in this sliding engagement. Thereafter, a bucket or similar canister container 36 may be placed in the opening 13, the flange 37 of the container 36 resting on the loop 12 to firmly support the container 36. The flange 20 precludes accidental removal of the device 11 from the step by preventing unintentional sliding release of the step by the device 11.

Figure 5:
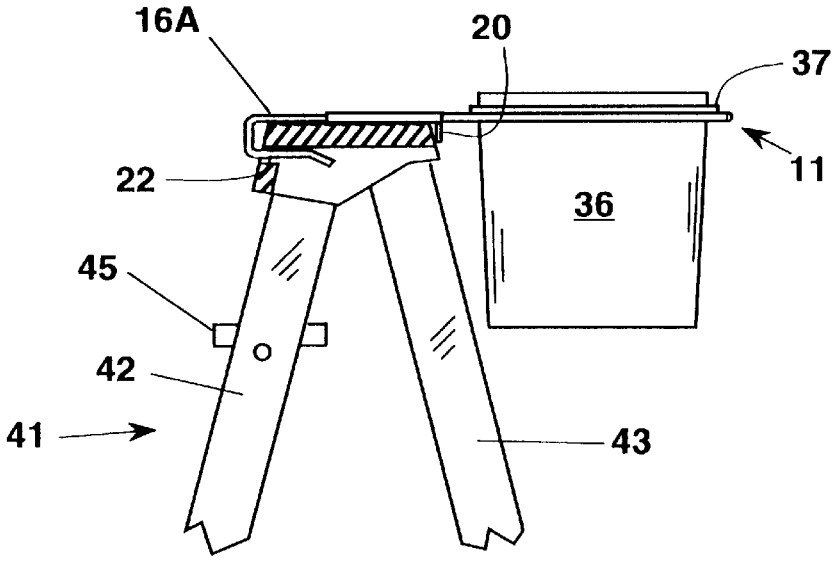
FIG. 5 is a partially cutaway side elevation depicting the paint container support device secured to the slotted top step assembly as shown in FIG. 4.
Figure 4:
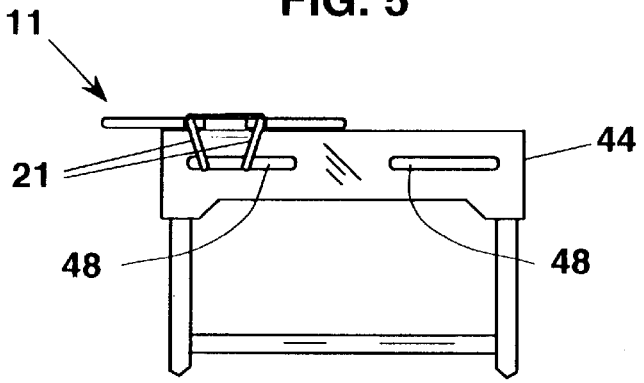
FIG. 4 is an end view of the paint container support device engaged with a stepladder having a slotted top step assembly.

With regard to FIGS. 4 and 5, one particular form of stepladder includes a pair of parallel rails 42 bearing a plurality of steps 45, and another pair of parallel rails 43, both pairs of rails being pivotally joined to an upper step housing assembly 44. The assembly 44 includes a pair of horizontally extending slots 48 spaced apart laterally, the slots being dimensioned to receive the segments 22 and 23 of the device 11 in slidable fashion. The function of the flange 20 and the engagement of the container flange 37 with the arcuate segment 12 are as described previously. The engagement of the segments 21 and 22 in either of the slots 48 prevents lateral movement of the device 11, further securing the device to the ladder.

Figure 10:
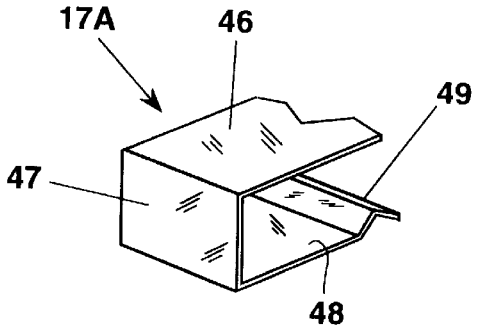
FIG. 10 is an enlarged perspective view of a further embodiment of the gripper portion of the device of the present invention.

In a further embodiment of the invention, shown in FIG. 10, the linear segments 16 extend to be secured to the tang 17A, and are terminated thereat. The tang 17A includes a proximally extending portion 46, and a portion 47 extends therefrom in orthogonal relationship. A portion 48 extends orthogonally from the portion 47, and is disposed generally parallel and spaced apart from the proximal portion 46. A flange 49 extends obliquely downwardly from the distal end of the portion 48. The portions 46, 47, 48, and 49 correspond in size, form and function to the segments 16A, 21, 22, and 23, respectively, and may be employed as described with reference to FIGS. 4–6.

In either embodiment, the bucket or canister supported by the loop portion of the device may also be used to support tools for painting, plastering, surface preparation, drywall lay-up, plumbers, pipe fitters, and the like. Supporting tools and implements on the ladder itself reduces the need for a waist belt tool pouch, thereby eliminating a source of lower back strain. Moreover, having the tools at the top of the ladder reduces the number of trips up and down the ladder for tools and supplies. Each 5 gallon bucket may hold up to 20 pounds of tools, equipment, and supplies, and a 2 gallon bucket may support up to 8 pounds of such material.

Figure 7:
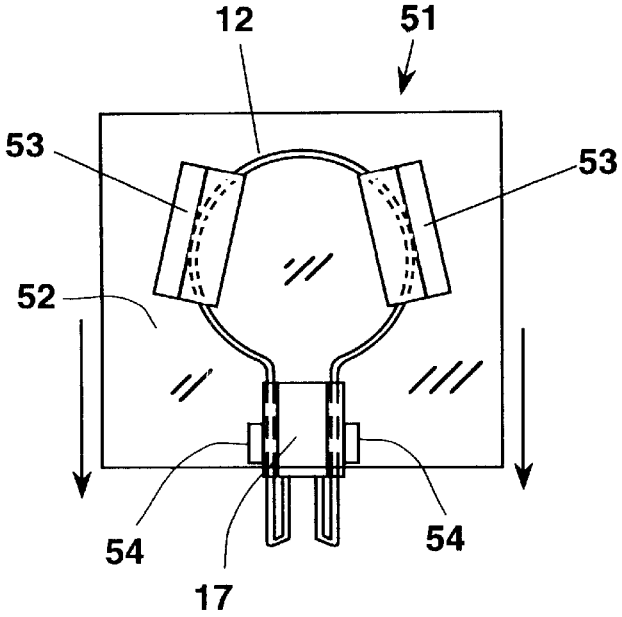
FIG. 7 is a bottom view of the painter's tray embodiment of the invention secured to the paint container support device.
Figure 8:
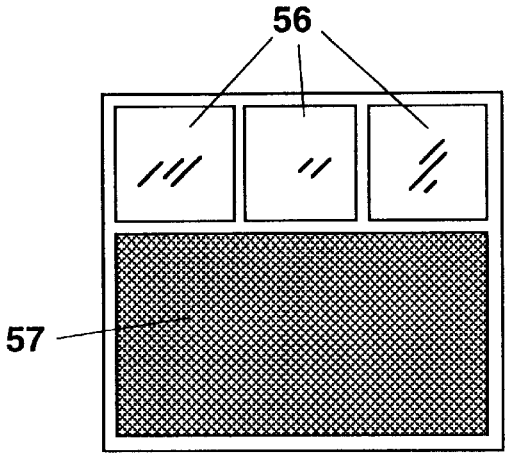
FIG. 8 is a top view of the painter's tray embodiment depicted in FIG. 7.
Figure 9:
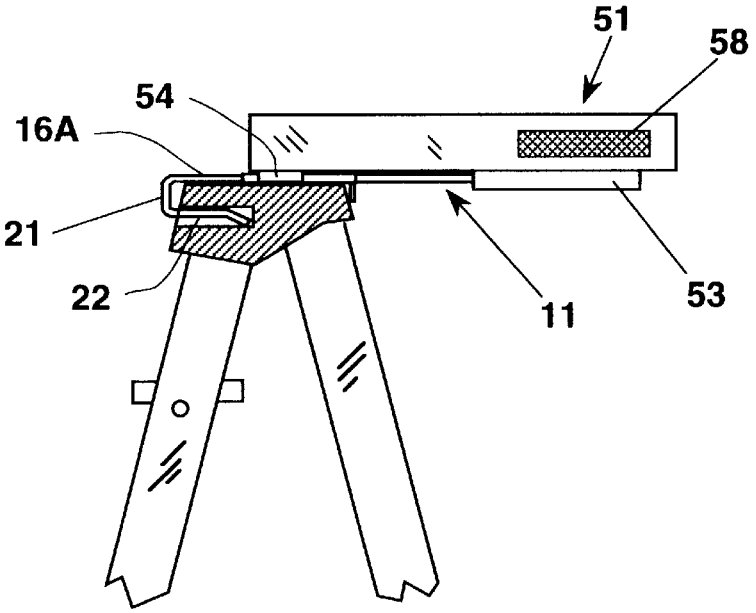
FIG. 9 is a side elevation of the painter's tray embodiment of the invention secured to the paint container support device and engaged in the slotted top step assembly as shown in FIGS. 4 and 5.

A further aspect of the invention is the provision of a painter's tray 51, as depicted in FIGS. 7–9. The painter's tray includes a generally rectangular bottom panel 52, and a pair of channel members 53 are secured to the bottom surface of the bottom panel. The channel members 53 are disposed in obliquely confronting, spaced apart relationship, whereby the arcuate portion 12 of the device 11 may be slidably inserted into the channel members 53. A pair of guide blocks 54 are also secured to the bottom surface adjacent to one edge of the bottom panel 52, and spaced apart to receive therebetween the tang member 17 of the device 11. It may be appreciated that the tray may be engaged with the device 11 by placing the tray over the device 11 with the guide blocks disposed superjacently and centered with respect to the arcuate portion 12, and translating the tray 51 in the direction shown by the arrows in FIG. 7. The arcuate portion 12 will thus be inserted into the channel members 53, and the tang member 17 will extend between the guide blocks 54. The tray 51 is thereby secured to the device 11, and the device 11 provides support for the tray due to the impingement of the bottom panel 52 on the arcuate portion 12 and tang 17.

As shown in FIG. 8, the tray 51 may include a plurality of compartments 56 devoted to differentiated uses. For example, the compartments may be configured to hold various tools and implements for surface preparation, such as scrapers, tape, brushes, and other paraphernalia. The tray may further include a magnetic strip or portion 58 to retain nails and screws removed from the surfaces being prepared. Alternatively, the tray 51 may be configured for faux painting, with each compartment 56 containing different color paints. One compartment may include a dabbing screen 57 for removing excess paint from the faux applicators.

As shown in FIG. 9, the tray 51 is supported by the device 11, which in turn is supported on a ladder 31 or 41 as described previously. The tray 51 is disposed in a convenient location for the user to stand on the ladder and access the tools, supplies, or paint and accessories provided by the tray.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

I claim:

1. A device for supporting a paint container on a ladder, including:

an arcuate portion extending distally and horizontally and having an upwardly extending opening adapted to receive and retain the paint container;

a medial portion joined to said arcuate portion and extending generally horizontally therefrom;

a proximal portion extending from said medial portion, said proximal portion including gripper means for releasably engaging a step of the ladder to support said arcuate portion in cantilever fashion;

said arcuate portion including a rigid rim describing a substantial portion of a circle;

said medial portion including a pair of linear members extending integrally from said rigid rim;

said medial portion including a tang member, and means for joining said tang member to said linear members in permanent, rigid fashion;

flange means extending rigidly and fixedly from said tang member in confronting, spaced apart relationship to said gripper means to engage therebetween and releasably secure the step of the ladder in supported relationship, said arcuate portion, medial portion, and proximal portion formed integrally of rigid rod, said arcuate portion and medial portion extending in a first plane, said gripper means including opposed end portions of said rigid rod extending in a second plane generally parallel to and spaced apart from said first plane, said flange means including a flange depending between said pair of linear members and disposed in confronting, spaced apart relationship to said end portions of said rigid rod.

2. The device of claim 1, wherein said tang member is adapted to impinge on the top surface of the step of the ladder, and said gripper means includes means for engaging the bottom surface of the step of the ladder, whereby the step is clamped and engaged.

3. The device of claim 2, wherein is adapted to engage a first laterally extending edge of the step of the ladder.

4. The device of claim 3, wherein said gripper means engages a second laterally extending edge of the step of the ladder.

5. The apparatus for supporting a paint container on a ladder, including:

an arcuate portion extending distally and horizontally and having an upwardly extending opening adapted to receive and retain the paint container;

a medial portion joined to said arcuate portion and extending generally horizontally therefrom;

a proximal portion extending from said medial portion, said proximal portion including gripper means for releasably engaging a step of the ladder to support said arcuate portion in cantilever fashion;

said arcuate portion including a rigid rim describing a substantial portion of a circle;

said medial portion including a pair of linear members extending integrally from said rigid rim;

said medial portion including a tang member, and means for joining said tang member to said linear members in permanent, rigid fashion;

further including a removable tray adapted to be supported on said rigid rim and said tang member whenever the paint container is not received in said arcuate portion;

said tray including a bottom panel having a bottom surface adapted to impinge on said rigid rim and said tang member, and further including a plurality of channel members arrayed on said bottom surface and adapted to engage said rigid rim in slidable, releasable fashion.

6. The apparatus of claim 5, wherein said tray further includes a pair of guide blocks secured to said bottom surface and spaced apart to receive said tang member therebetween.

7. The apparatus of claim 6, wherein said tray further includes a plurality of compartments opening upwardly.

8. The apparatus of claim 7, wherein at least one of said compartments is adapted to contain painting implements.

9. The apparatus of claim 7, wherein at least one of said compartments is adapted to contain paint.

10. The apparatus of claim 7, wherein at least one of said compartments is adapted to support a dabbing screen for faux painting.

11. The apparatus for supporting a paint container on a ladder, including:

an arcuate portion extending distally and horizontally and having an upwardly extending opening adapted to receive and retain the paint container;

a medial portion joined to said arcuate portion and extending generally horizontally therefrom;

a proximal portion extending from said medial portion, said proximal portion including gripper means for releasably engaging a step of the ladder to support said arcuate portion in cantilever fashion;

said arcuate portion including a rigid rim describing a substantial portion of a circle;

said medial portion including a pair of linear members extending integrally from said rigid rim;

said medial portion including a tang member, and means for joining said tang member to said linear members in permanent, rigid fashion; and a removable tray adapted to be supported on said rigid rim and said tang member, and means extending from said tray to engage said rigid rim in slidable, releasable fashion when the paint container is not received in said arcuate portion.

* * * * *